US007524225B1

(12) United States Patent
Richenberg et al.

(10) Patent No.: US 7,524,225 B1
(45) Date of Patent: Apr. 28, 2009

(54) HYDRODYNAMIC RIDGE DEVICES FOR SMALL WATERCRAFT

(76) Inventors: Randal Robert Richenberg, P.O. Box 2394, New Smyrna Beach, FL (US) 32170; Christopher Kevin Coyle, 805 Faulkner St., New Smyrna Beach, FL (US) 32168

( * ) Notice: Subject to any disclaimer, the term of this patent is extended or adjusted under 35 U.S.C. 154(b) by 89 days.

(21) Appl. No.: 11/602,424

(22) Filed: Nov. 19, 2006

Related U.S. Application Data

(63) Continuation-in-part of application No. 11/176,532, filed on Jul. 5, 2005, now abandoned.

(51) Int. Cl.
*B63B 35/81* (2006.01)

(52) U.S. Cl. ..... 441/74; 441/79

(58) Field of Classification Search ..... 441/65, 441/74, 79

See application file for complete search history.

(56) References Cited

U.S. PATENT DOCUMENTS 4,878,980 A * 11/1989 Stedman ..... 441/74
5,152,705 A * 10/1992 Rock ..... 441/74
6,001,471 A * 12/1999 Bries et al. ..... 428/343
6,106,347 A * 8/2000 Harness ..... 441/79
6,149,479 A * 11/2000 Redmon et al. ..... 441/79
6,551,157 B1 * 4/2003 Bishop ..... 441/65
6,718,897 B1 * 4/2004 De Bello ..... 441/74
6,811,456 B2 * 11/2004 Redmon ..... 441/79

* cited by examiner

*Primary Examiner*—Lars A Olson
(74) *Attorney, Agent, or Firm*—Kenneth A. Roddy

(57) ABSTRACT

Hydrodynamic ridge devices for mounting in pairs on the bottom of aquatic sports watercraft to form channels that capture lateral water flow and direct it longitudinally to enhance stability, speed, control, and performance of the watercraft. Each ridge device is a longitudinal body with a short flat vertical side, a wide flat top side extending horizontally from the top of the vertical side perpendicular thereto terminating in a convex generally arcuate outer edge, and a convex curved bottom side. The vertical side has an arcuate bottom edge that curves upwardly to a point at each end. The outer edge of the top side curves inwardly at each end to the points at the ends of the vertical side, and the curved bottom side curves upwardly and outwardly from the bottom of the vertical side to join the outer edge of the top side and the vertical side end points.

1 Claim, 3 Drawing Sheets

HYDRODYNAMIC RIDGE DEVICES FOR SMALL WATERCRAFT

CROSS REFERENCE TO RELATED APPLICATION

This application is a Continuation-In-Part and claims priority from U.S. patent application Ser. No. 11/176,532, filed Jul. 5, 2005, now abandoned.

BACKGROUND OF THE INVENTION

1. Field of the Invention

This invention relates generally to aquatic sports watercraft, and more particularly to hydrodynamic ridge devices that can be retrofitted onto the bottom of existing small aquatic sports watercraft, such as surfboards, sailboards, wakeboards, and the like, to capture lateral water flow and redirect it longitudinally and thereby provide-improved stability, speed, control, and performance of the watercraft.

2. Background Art

There are several patents directed toward hydrodynamic devices that can be retrofitted onto existing aquatic sports watercraft. However, most of these devices are limited in their functionality, and some are restricted in the manner of application and/or the configuration of the ridges, channels or grooves.

Olsen, U.S. Design Pat. No. 323,691, illustrates an approach of configuring grooves into the bottom of a surfboard as an integral part of the surfboard. This method is permanent and does not allow for different configurations or shapes.

Stedman, U.S. Pat. No. 4,878,980 discloses a group of elongate extruded molding strips originally designed and intended for use as automobile protective side-molding that can be A retrofitted onto wave riding vehicles. The molding strips are semicircular or half-round in transverse cross section and have an angled leading edge at one end.

Lewis, U.S. Pat. No. 5,480,331 discloses a flexible fin for surfboards, sailboards and other watercraft, which comprises a thin core sheet made of laminated fiberglass sandwiched between two slabs of closed-cell polyurethane foam. The flexible fin provides for sharper turns while increasing the buoyancy of the craft.

Harness, U.S. Pat. No. 6,106,347 discloses a rectangular guidance pad, made from flexible plastic material having a flat top surface provided with a layer of self-adhesive material retained by a peel-off backing, and an array of parallel longitudinal V-shaped raised ridges integrally molded on the bottom side. The pad can be retrofitted onto the bottom side of an aquatic sports device such as a surfboard just forward of the fin, for which a cutaway region is provided at the aft edge of the pad. The parallel ridges define channels therebetween to enhance lateral stability by guiding water flow through the channels formed between the ridges.

Fryar, U.S. Pat. No. 6,585,549 discloses a momentum induced wakeboard stabilization system, wherein the wakeboard has rear, rear quarter, front quarter and front, vane pairs along the laterally opposed sides that channel water towards the longitudinal axis of the wakeboard to provide directional stabilization for the wakeboard. The vane pairs enhance rider control and performance of the wakeboard during maneuvers without the use of fins or hydrofoils.

The present invention is distinguished over the prior art in general, and these patents in particular by hydrodynamic ridge devices for mounting in pairs on the bottom of existing small aquatic sports watercraft to define one or more channels that capture lateral water flow and redirect it longitudinally and thereby provide improved stability, speed, control, and performance of the watercraft. Each ridge device has an elongate main body portion with a short flat vertical side, a wide flat top side extending horizontally from the top edge of the vertical side generally perpendicular thereto terminating in a convex generally arcuate outer edge, and a convex curved bottom side. The short vertical side has an arcuate bottom edge that curves upwardly to a point at each end. The convex arcuate outer edge curves inwardly at each end to join the respective points at the ends of the vertical side, and the convex curved bottom side curves upwardly and outwardly from the bottom edge of the vertical side to adjoin the arcuate outer edge of the top side and the respective points at the ends of the vertical side. The top side is provided a peel and stick pressure sensitive layer for securing the ridge device to the bottom surface of the watercraft.

SUMMARY OF THE INVENTION

It is therefore an object of the present invention to provide hydrodynamic ridge devices that can be easily and quickly mounted onto the bottom of existing small aquatic sports watercraft to increase stability, speed, control, and performance or the watercraft.

It is another object of this invention to provide hydrodynamic ridge devices that can be mounted in pairs onto the bottom of existing small aquatic sports watercraft to define one or more channels therebetween that capture lateral water flow and redirect it longitudinally along the underside of the watercraft and thereby provide improved stability, speed, control, and performance of the watercraft.

Another object of this invention is to provide hydrodynamic ridge devices that can be mounted onto the bottom of existing small aquatic sports watercraft in laterally spaced pairs at selective distances apart to form one or more channels of a desired width to achieve various beneficial hydrodynamic effects, stability, speed, control, and performance of the watercraft.

Another object of this invention is to provide hydrodynamic ridge devices that can be mounted in onto the bottom of existing small aquatic sports watercraft at various locations and in various patterns to channel water flow and direct it longitudinally along the underside of the watercraft to achieve various beneficial hydrodynamic effects, stability, speed, control, and performance of the watercraft.

Another object of this invention is to provide hydrodynamic ridge devices that can be mounted in onto the bottom of existing small aquatic sports watercraft without the use of tools and does not require modification of the watercraft structure for their installation.

A still further object of this invention is to provide hydrodynamic ridge devices for mounting onto the bottom of existing small aquatic sports watercraft to achieve various beneficial hydrodynamic effects, which are simple in design, inexpensive to manufacture and rugged and reliable in operation.

Other objects of the invention will become apparent from time to time throughout the specification and claims as hereinafter related.

The above noted objects and other objects of the invention are accomplished by the present hydrodynamic ridge devices for mounting in pairs on the bottom of existing small aquatic sports watercraft to define one or more channels that capture lateral water flow and redirect it longitudinally and thereby provide improved stability, speed, control, and performance of the watercraft. Each ridge device has an elongate main body portion with a short flat vertical side, a wide flat top side extending horizontally from the top edge of the vertical side generally perpendicular thereto terminating in a convex generally arcuate outer edge, and a convex curved bottom side. The short vertical side has an arcuate bottom edge that curves upwardly to a point at each end. The convex arcuate outer edge curves inwardly at each end to join the respective points at the ends of the vertical side, and the convex curved bottom side curves upwardly and outwardly from the bottom edge of the vertical side to adjoin the arcuate outer edge of the top side and the respective points at the ends of the vertical side. The top side is provided a peel and stick pressure sensitive layer for securing the ridge device to the bottom surface of the watercraft.

DESCRIPTION OF THE PREFERRED EMBODIMENT

Figure 1:
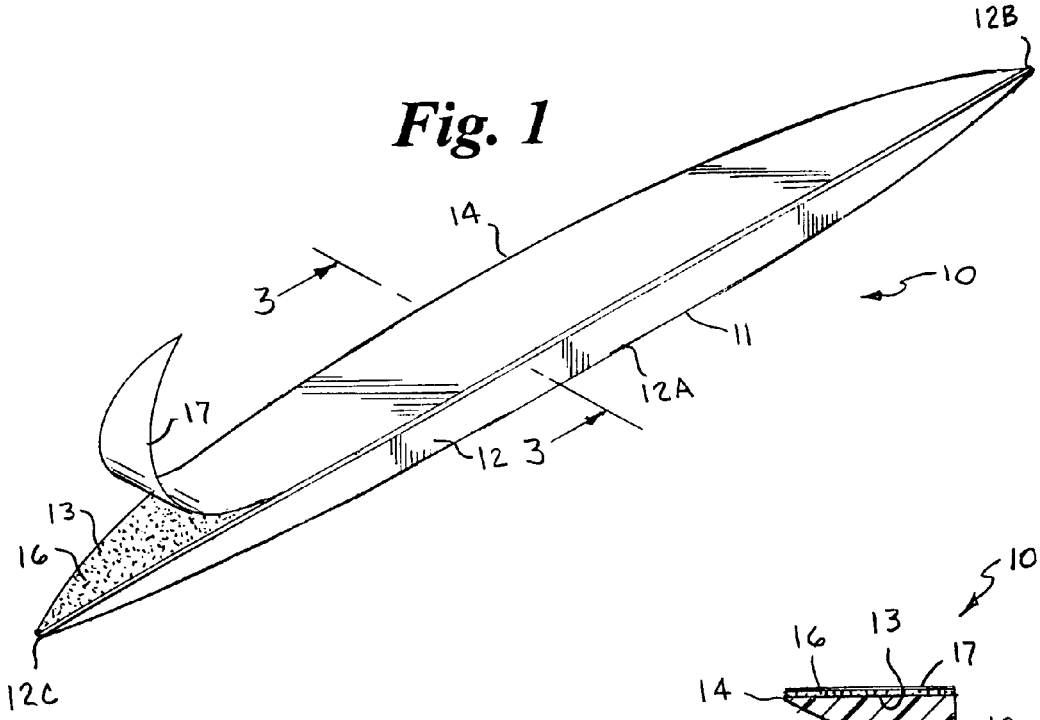
FIG. 1 is an isometric view a hydrodynamic ridge device in accordance with the present invention as seen from the top.
Figure 3:
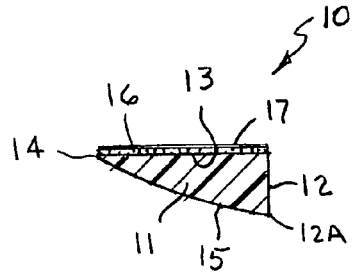
FIG. 3 is an enlarged transverse cross sectional view of the hydrodynamic ridge device taken along line 3-3 of FIG. 1.
Figure 2:
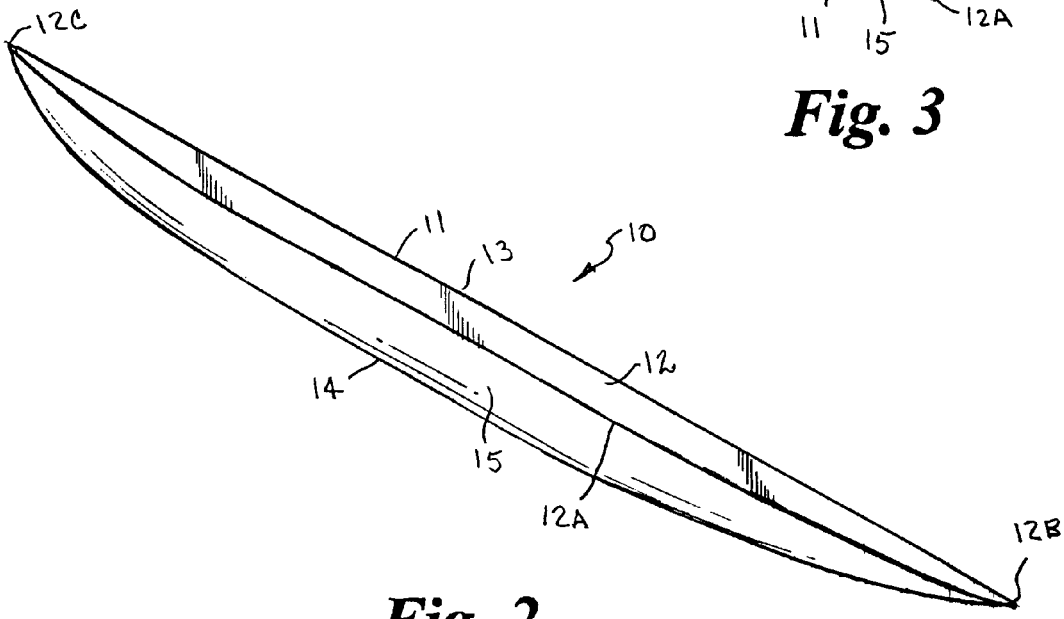
FIG. 2 is an isometric view of the hydrodynamic ridge device as seen from the bottom.

Referring to the drawings by numerals of reference, there is shown in FIGS. 1, 2 and 3, a example of a preferred hydrodynamic ridge device 10 that can be retrofitted onto the bottom surface of existing aquatic sports small watercraft, such as surfboards, sailboards, wakeboards, and the like, to capture lateral water flow and redirect it longitudinally along the bottom surface and thereby provide improved speed, control, and performance of the watercraft.

In a preferred embodiment, each hydrodynamic ridge device 10 has an elongate main body portion 11 (for example about 11¼ inches long) with a short flat vertical side 12, a wide flat top side 13 which extends horizontally outward from the straight top edge of the vertical side generally perpendicular thereto terminating in a convex generally arcuate outer edge 14, and a convex smoothly curved bottom side 15.

The short flat vertical side 12 has a generally arcuate bottom edge 12A of a maximum height at its midsection (for example about ⅜ of an inch) that curves upwardly at each end to a point 12B and 12C. The top surface 13 has a maximum width at its mid section (for example about 1 inch) and its convex generally arcuate outer edge 14 curves inwardly at each end to join the respective points 12B and 12C at the outer ends of the shorter flat vertical side 12. The bottom side 15 of each ridge device 10 is a convex smoothly curved surface that curves upwardly and outwardly from the generally arcuate bottom edge 12A of the vertical side 12 to adjoin the convex generally arcuate outer edge 14 of the top side 13, and the respective points 12B and 12C at the outer ends of the shorter flat vertical side. As best seen in FIG. 3, the ridge device 10 has a generally triangular pie-shaped transverse cross section at its center.

Thus, the main body 11 of the ridge device 10 is thicker at its mid section and diminishes symmetrically in thickness along its width and length in a gradual curve to the respective points 12B and 12C at opposed ends. It should be understood that the dimensions discussed above are for purposes of example only, and that the length of the main body, the height of the short flat vertical side, and width of the top side may be of other dimensions. Preferably the length of the main body 11 is greater than the width of the top side 13, and the width of the top side is greater than the height of the vertical short side 12.

The flat top side 13 of the ridge device 10 is provided with a coating or layer or pressure sensitive adhesive material 16, such as double-sided adhesive tape, which is covered by a protective strip of paper 17 which can be peeled away to expose the adhesive material, and the ridge devices can be mounted by firmly pressing them onto the bottom surface of the watercraft. It should be understood that, alternatively, various other conventional mounting means may be used, such as gluing, bonding, epoxy, etc.

The ridge devices 10 can be easily and quickly mounted on the bottom surface of the watercraft in pairs at various locations, preferably at the aft end of the watercraft, in laterally spaced apart relation with their short flat vertical sides 12 facing the central longitudinal axis of the bottom surface of the watercraft in opposed relation and their arcuate outer edges 14 facing respective lateral sides of the watercraft. When mounted on the bottom surface of the watercraft, the spaced apart short flat vertical sides 12 of the ridge devices 10 define a water flow channel therebetween, and the points 12B and 12C of symmetrically diminished thickness at the opposed ends of the ridge devices form respective water entry and water exit points at each end of the channel formed therebetween. The width of the channel can be varied to achieve various hydrodynamic effects by selectively positioning the ridge devices a desired distance apart. The channel formed between the flat vertical sides 12 of the ridge devices 10 captures lateral water flow and redirects it longitudinally along the bottom surface of the watercraft and thereby provide improved stability, speed, control, and performance of the watercraft.

The points 12B and 12C of symmetrically diminished thickness at the opposed ends of the ridge devices 10, their symmetrically curved convex bottom side 15 (facing downward when the watercraft is in the water) and their convex arcuate outer edges 14 facing the lateral sides of the watercraft form streamlined longitudinal water flow surfaces on the outer sides of the channel that reduce turbulence or swirling of the water flow on the outer sides of the channel.

Figure 4:
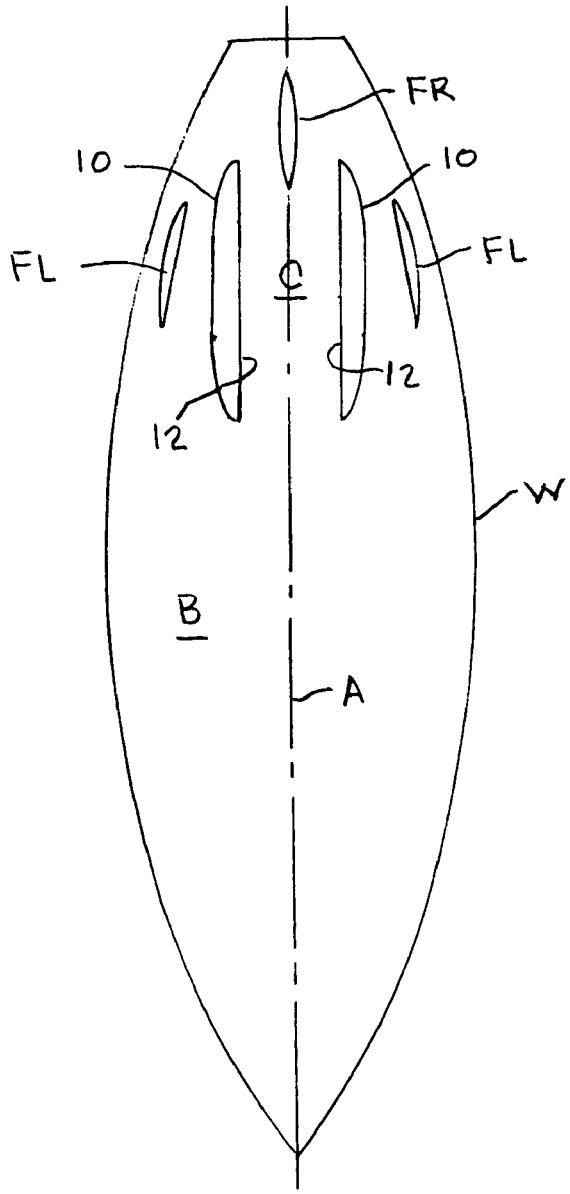
FIGS. 4 and 5 are a bottom view and front end view, respectively, showing, somewhat schematically, a pair of the ridge devices mounted on the bottom surface of a conventional surfboard defining a relatively wide channel at the aft end.
Figure 5:
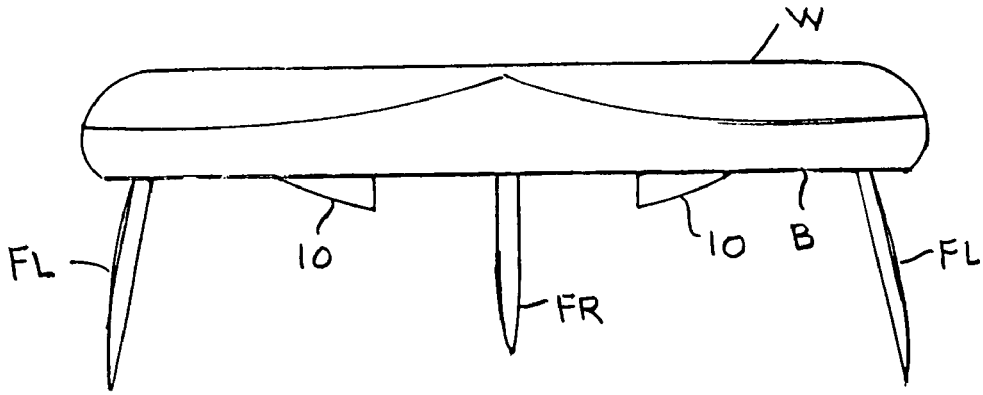

FIGS. 4 and 5 show, somewhat schematically, a pair of the ridge devices 10 mounted on the bottom surface B of a conventional watercraft W (surfboard) of a three-fin design having a central rear fin FR at the aft or tail end of the of the board and two laterally spaced fins FL disposed slightly forward towards the front or nose of the board. In this example, a respective ridge device 10 is disposed between the central rear fin FR and each lateral fin FL, with their short flat vertical sides 12 facing the central longitudinal axis "A" of the bottom surface of the board in opposed relation defining a relatively wide channel C therebetween.

Figure 6:
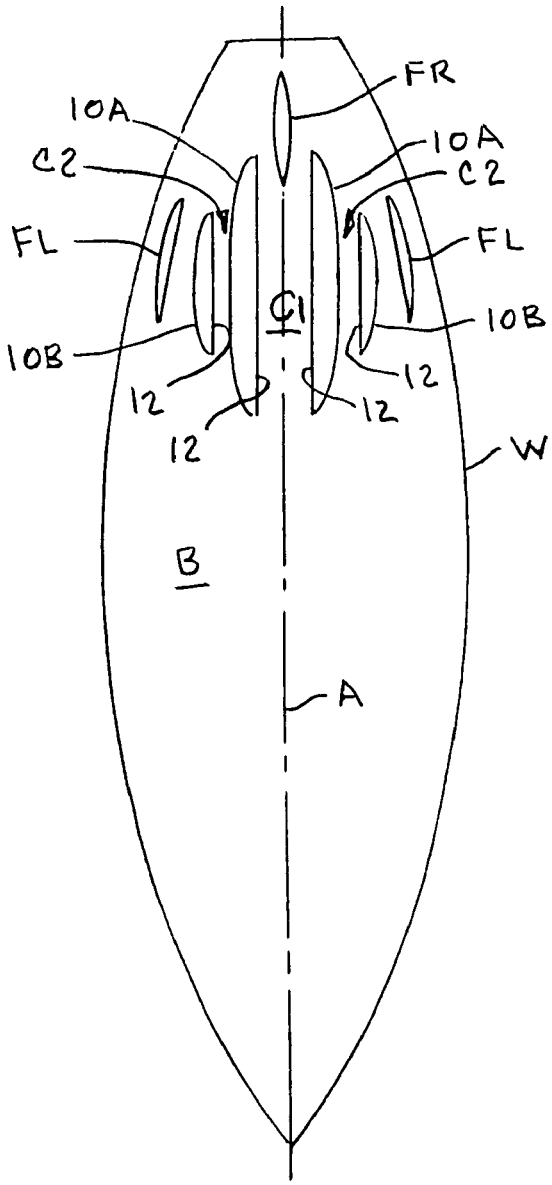
FIGS. 6 and 7 are a bottom view and front end view, respectively, showing, somewhat schematically, two pairs of the ridge devices mounted on the bottom surface of the conventional surfboard defining a central channel and a pair of channels at each side thereof.
Figure 7:
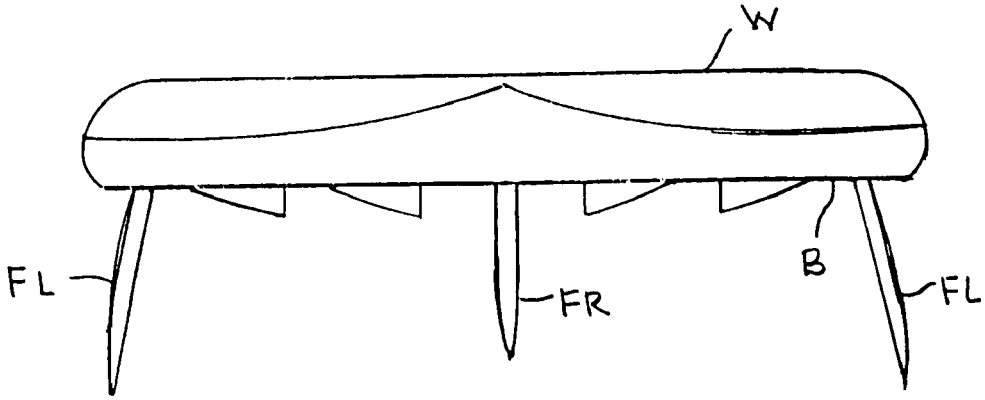

FIGS. 6 and 7 show, somewhat schematically, two pairs of the ridge devices 10A and 10B mounted on the bottom surface B the conventional three-fin watercraft W (surfboard), wherein a pair of ridge devices 10A and 10B are disposed in laterally spaced relation between the central rear fin FR and each lateral fin FL, with their short flat vertical sides 12 facing the central longitudinal axis "A" of the bottom surface of the board in opposed relation defining a central narrower channel C1 and a pair of narrower channels C2 at each side thereof.

Thus, it should be understood from the foregoing that the present hydrodynamic ridge devices can be easily and quickly mounted onto the bottom of existing small aquatic sports watercraft in laterally spaced pairs at selective distances apart and at various locations and in various patterns to channel water flow and direct it longitudinally along the underside of the watercraft to achieve various beneficial hydrodynamic effects, stability, speed, control, and performance of the watercraft.

The foregoing disclosure and description of the invention is illustrative and explanatory thereof. While this invention has been described fully and completely with special emphasis upon preferred embodiments, no limitations are intended to the details of construction or design, herein shown, or to the methods described herein and it should be understood that various changes in the details of the illustrated construction and methods may be made within the scope of the appended claims.

The invention claimed is:

1. At least one pair of hydrodynamic ridge devices for attachment to the bottom surface of an existing surfboard, to channel lateral water flow and direct it longitudinally along the underside of the surfboard to provide beneficial hydrodynamic effects, stability, speed, control, and performance of the surfboard, each hydrodynamic ridge device comprising:

an elongate longitudinal body having a short flat vertical side, a wide flat top side extending horizontally from a top edge of said vertical side generally perpendicular thereto terminating in a convex generally arcuate outer edge, and a convex curved bottom surface extending between a bottom edge of said vertical side and said arcuate outer edge of said top side;

said bottom edge of said short vertical side being an arcuate bottom edge that curves upwardly to a point at each end, said convex arcuate outer edge of said top surface curving inwardly at each end to join a respective said point at each end of said vertical side, and said convex curved bottom surface curving upwardly and outwardly from said vertical side bottom edge to adjoin said top side arcuate outer edge and said respective point at each end of said vertical side;

said flat top side having a width greater than the height of said short vertical side;

said elongate longitudinal body having a generally triangular pie-shaped transverse cross sectional shape at its midsection defined by said vertical side, said top side, and said bottom side, and said elongate longitudinal body being thicker at its midsection and diminishing symmetrically in thickness along its width and length in a gradual curve toward each said respective point at each end of said vertical side; and a layer of adhesive material on said flat top side covered by a protective backing layer to be peeled off for adhesively mounting said longitudinal body to the bottom surface of the existing surfboard in a generally aft region thereof.

* * * * *